US007395763B1

(12) United States Patent
Vari

(10) Patent No.: US 7,395,763 B1
(45) Date of Patent: Jul. 8, 2008

(54) SYSTEM AND METHOD FOR INTRODUCING A CLEANING ELEMENT INTO THE BARREL OF A PAINTBALL MARKER

(76) Inventor: Daniel P. Vari, 33 Lenape Rd., Richboro, PA (US) 18954

( * ) Notice: Subject to any disclaimer, the term of this patent is extended or adjusted under 35 U.S.C. 154(b) by 175 days.

(21) Appl. No.: 11/217,419

(22) Filed: Sep. 2, 2005

(51) Int. Cl.
*F41A 29/00* (2006.01)
*F41A 9/61* (2006.01)

(52) U.S. Cl. ..... 102/529; 124/48; 42/95

(58) Field of Classification Search ..... 102/529, 102/442, 513; 124/45, 48, 49; 42/60, 61, 42/62

See application file for complete search history.

(56) References Cited

U.S. PATENT DOCUMENTS 2,609,811 A * 9/1952 Lawrence ..... 124/48
4,819,609 A * 4/1989 Tippmann ..... 124/72
4,986,251 A * 1/1991 Lilley ..... 124/67
5,845,629 A * 12/1998 Ratliff ..... 124/56
6,470,871 B2 * 10/2002 Casas-Salva ..... 124/48
6,488,019 B2 * 12/2002 Kotsiopoulos ..... 124/51.1
6,532,946 B1 3/2003 Paquette ..... 124/49
6,739,323 B2 * 5/2004 Tippmann, Jr. ..... 124/51.1
6,745,755 B2 * 6/2004 Piccini ..... 124/49

* cited by examiner

*Primary Examiner*—Bret Hayes
(74) *Attorney, Agent, or Firm*—LaMorte & Associates

(57) ABSTRACT

An assembly and method for cleaning the barrel of a pneumatic gun, such as a paintball marker. A supply magazine is provided that contains a plurality of loading ports. Each loading port is filled with a cleaning projectile. The supply magazine is attached to a pneumatic gun so that the supply magazine is interposed between the breach chamber of the pneumatic gun and its barrel. When a projectile is fired from the pneumatic gun, the projectile displaces a cleaning projectile from the supply magazine and advances the cleaning projectile through the barrel. The passage of the cleaning projectile and the accompanying paintball cleans any fouling from the barrel of the pneumatic gun.

14 Claims, 3 Drawing Sheets

SYSTEM AND METHOD FOR INTRODUCING A CLEANING ELEMENT INTO THE BARREL OF A PAINTBALL MARKER

BACKGROUND OF THE INVENTION

1. Field of the Invention

In general, the present invention relates to the structure of paintball markers. More particularly, the present invention relates to paintball markers that have mechanisms for introducing a cleaning element into the barrel of the paintball marker without having to disassemble the paintball marker.

2. Prior Art Summary

Paintball is a sport that has become increasingly popular in recent years. In the sport of paintball, players shoot paintballs at opponents using paintball markers. Paintball markers, also known as paintball guns, are devices that are designed to shoot a paint filled paintball at a target at a speed of about 200 feet per second. The majority of paintball markers are pneumatic devices that use a compressed gas to project a paintball and power the triggering mechanism of the marker. The compressed gas is typically carbon dioxide, nitrogen, or compressed air. Regardless of its composition, the compressed gas is stored within a pressurized tank that attaches to the paintball marker.

Paintballs typically are thin-shelled structures that are filled with a colored liquid. When the paintball hits a hard surface, the shell of the paint ball ruptures and the colored liquid is released. A recurring problem with paintballs is that every so often the shell of the paintball will rupture inside the paintball gun as it is being fired. This causes colored liquid and shell fragments to coat the inside of the barrel of the paintball marker.

When the inside of a paintball marker's barrel is fouled with paintball liquid, that liquid contacts subsequent paintballs that are fired by the marker. Since the fouling in the barrel is uneven, the passing paintball meets different areas of resistance as it travels through the barrel. This causes the paintball to randomly spin within the barrel. When the spinning paintball exits the barrel, the spin on the paintball causes the paintball to fly erratically. The paintball therefore does not travel in the direction of aim.

In the prior art, there have been many devices invented to clean the remnants of a broken paintball from a paintball marker's barrel. Many of these cleaning devices are cleaning rods or tethers having plush brushes attached to their structures. When the rod or tether is pulled through the barrel, the plush brush wipes the interior of the barrel clean.

A problem associated with such cleaning devices is that they require the barrel be removed from the paintball marker prior to cleaning. The paintball marker must therefore be partially disassembled in order to be cleaned. This takes time and skill. The cleaning process is therefore very undesirable in the middle of a game of paintball when opponents are actively firing paintballs.

In the prior art, other cleaning systems have been developed that enable a paintball marker to be cleaned without removing the barrel of the paintball marker. In such prior art systems, a cleaning projectile is inserted into the barrel of the paintball gun. The cleaning projectile is then fired in place of a paintball. As the cleaning projectile is fired through the barrel, the cleaning projectile wipes clean the interior of the barrel.

In order to introduce a cleaning projectile into the barrel of a paintball marker without removing the barrel, the cleaning projectile must be introduced into the breach of the paintball marker. This often requires that the supply hopper of unfired paintballs be removed from the paintball marker. It also often requires that a person push the cleaning projectile into the breach of the paintball gun with their finger.

Many paintball guns have bolts that travel through the breach of a paintball marker and push the paintball into the barrel as the paintball marker is fired. If a person's finger is placed in front of the bolt during firing, the bolt can injure, or even sever, the finger. It is therefore very dangerous to manually introduce any object into the breach of a paintball marker.

In U.S. Pat. No. 6,532,946, to Paquette, entitled Apparatus And Method For Dispensing Cleaning Balls Used In A Paintball Gun, a paintball marker is shown that automatically introduces a cleaning projectile into the barrel of the paintball marker. To clean the paintball marker's barrel, the cleaning projectile must be larger than the diameter of the barrel. The cleaning projectile, therefore cannot be fed into the hopper of the paintball marker as if it were a paintball. Rather, in the Paquette patent, the paintball marker itself is specifically designed and built to accept the cleaning system that feeds the cleaning projectiles into the marker barrel. Accordingly, the Paquette device cannot be retroactively added to existing paintball markers.

A need therefore exists for a system that can introduce a cleaning projectile into the barrel of a paintball marker, without having to dissemble the paintball marker and without requiring a specialized paintball marker. This need is met by the present invention as claimed and described below.

SUMMARY OF THE INVENTION

The present invention is an assembly and method for cleaning the barrel of a pneumatic gun, such as a paintball marker. A supply magazine is provided that contains a plurality of loading ports. Each loading port is filled with a cleaning projectile. The supply magazine is attached to a pneumatic gun so that the supply magazine is interposed between the breach chamber of the pneumatic gun and the barrel. When a projectile is fired from the pneumatic gun, the projectile displaces a cleaning projectile from the supply magazine and advances the cleaning projectile through the barrel. The passage of the cleaning projectile and the accompanying paintball cleans any fouling from the barrel of the pneumatic gun.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention system can be used on any paintball marker with a removable barrel, such as barrels that attach with bayonet connections or aligned pins, the present invention is especially well suited for use with a paintball marker having a barrel with a threaded connection. Accordingly, the present invention is described as part of a paintball marker with a threaded barrel in order to set forth the best mode contemplated for the invention. Such a configuration, however, should not be considered a limitation to the application of the present invention to paintball markers with alternate barrel connection configurations.

Figure 1:
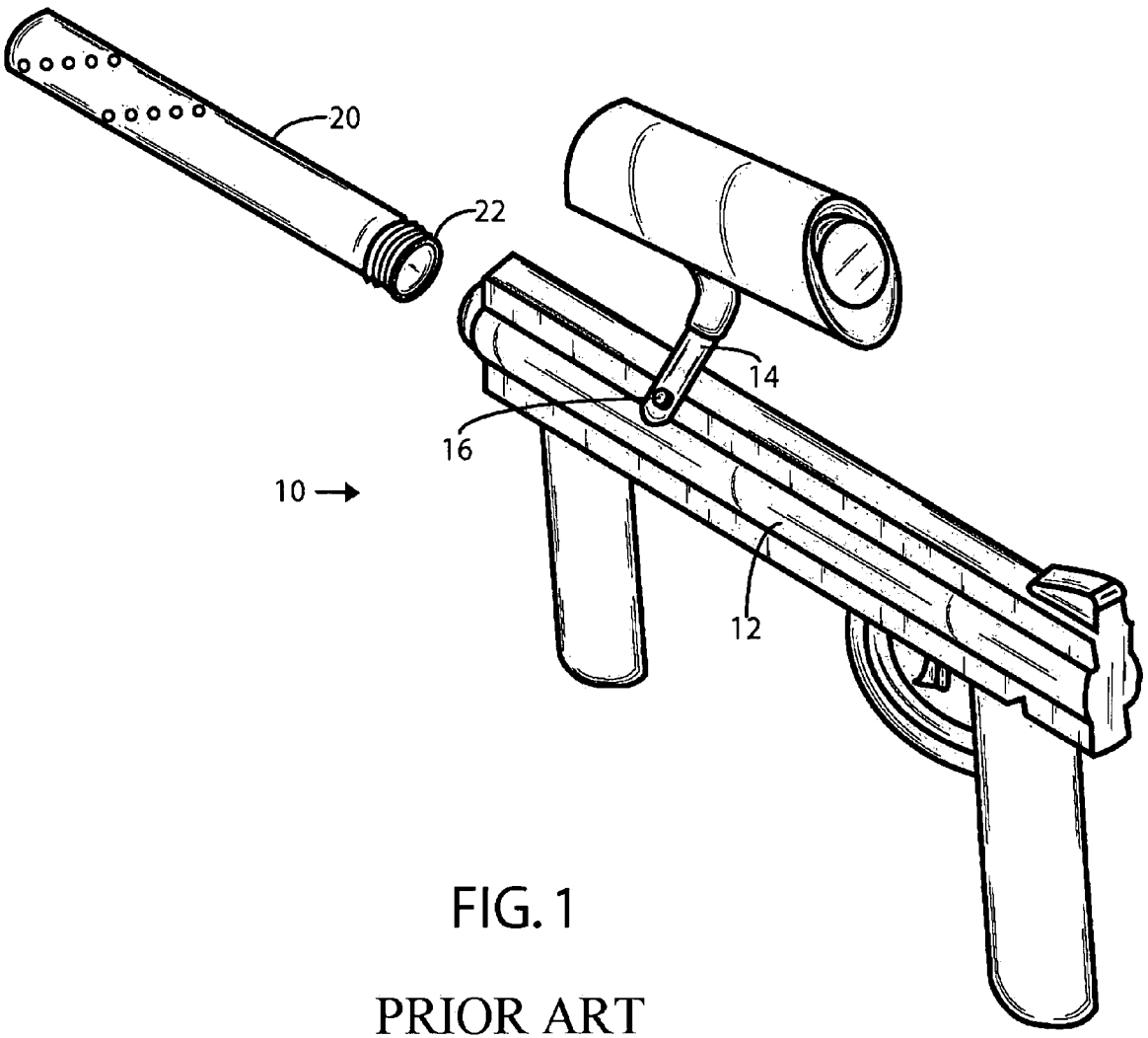
FIG. 1 PRIOR ART
FIG. 1 is a perspective view of an exemplary prior art paintball marker.

Referring to FIG. 1, there is shown a typical prior art paintball marker 10. The paintball marker 10 can be any known make or model. The paintball marker 10 has a gun frame 12. The gun frame 12 contains the firing mechanism of the paintball marker 10. A feed tube 14 extends from the gun frame 12. The feed tube 14 leads to the breach chamber 16 of the paintball marker 10. A supply hopper 18 is attached to the feed tube 14. The supply hopper 18 holds a number of paintballs and supplies those paintballs to the breach chamber 16 when the paintball marker 10 is fired.

A barrel 20 is attached to the front of the gun frame 12. The barrel 20 aligns with the breach chamber 16 so that a paintball fired from the breach chamber 16 will pass through the barrel 20. In the shown embodiment, the barrel 20 has a threaded end 22 that engages the gun frame 12. It will therefore be understood that a threaded port (not shown) is disposed on the front of the paintball marker 10 in order to receive the threaded end 22 of the barrel 20.

If a paintball were to break in the barrel 20 of the paintball marker 10, either the barrel 20 would have to be removed and cleaned, or the supply hopper 18 would have to be removed and a cleaning projectile introduced into the breach chamber 16.

Figure 2:
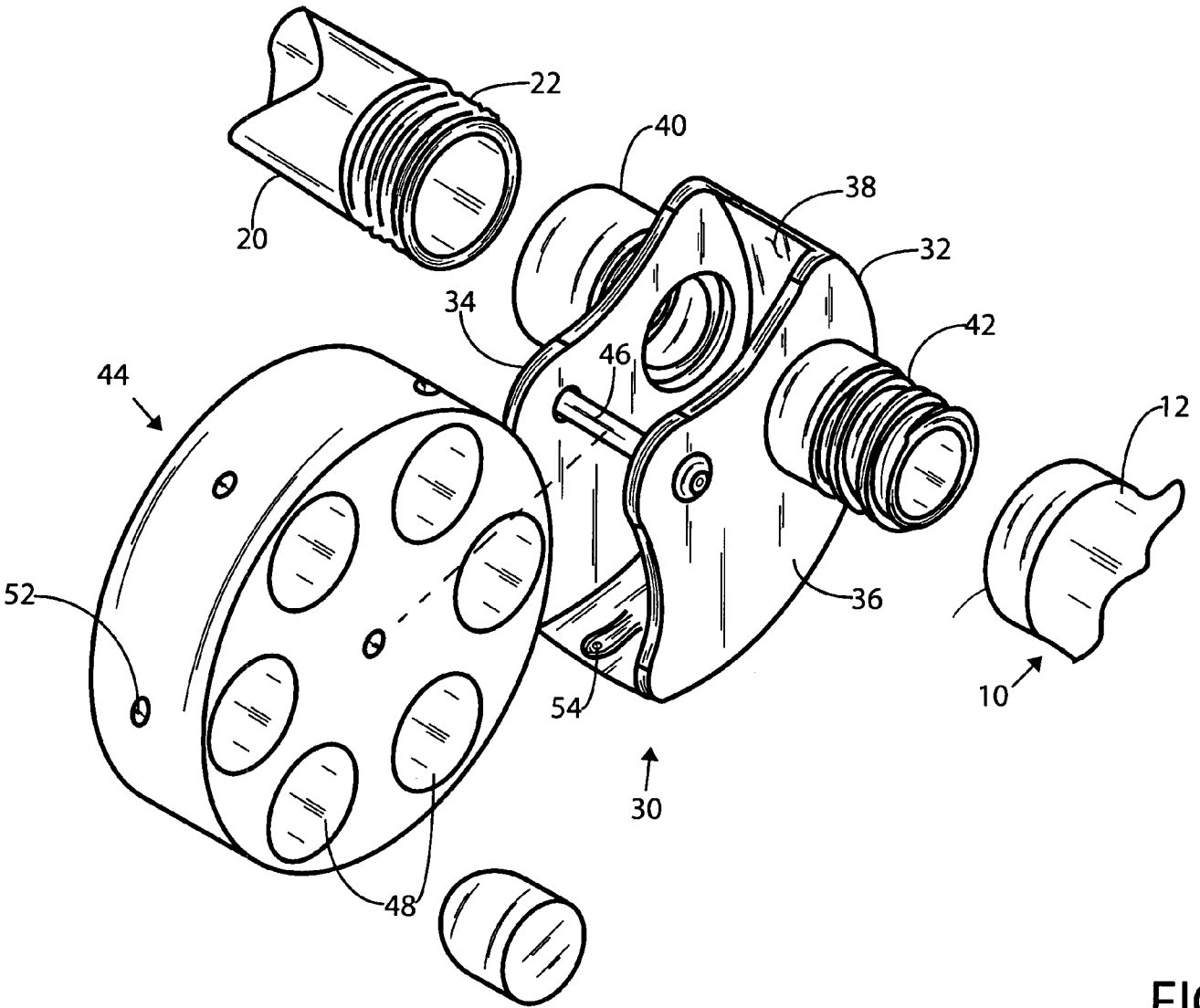
FIG. 2 is a perspective view of an exemplary embodiment of the present invention assembly.

Referring to FIG. 2, an exemplary embodiment of the present invention assembly 30 is shown. The assembly 30 has a primary housing 32. The primary housing 32 has a forward surface 34, a rearward surface 36 and an open area 38 disposed between the forward surface 34 and the rearward surface 36. A barrel receptacle 40 extends from the forward surface 34 of the primary housing 32. The barrel receptacle 40 is a threaded female structure that is sized to receive the threaded end 22 of the paintball marker barrel 20.

A barrel extension 42 extends from the rearward surface 36 of the primary housing 32. The barrel extension 42 is an externally threaded structure that mimics the size, shape and thread structure of the threaded end 22 of the barrel 20. Thus, the barrel extension 42 can thread into the gun frame 12 of the paintball marker 10 in place of the threaded end 22 of the barrel 20.

The barrel receptacle 40 on the forward surface 34 of the primary housing 32, and the barrel extension 42 on the rearward surface 36 of the primary housing 32 both axially align. Thus, a continuous straight pathway exists through the barrel extension 42, the primary housing 32 and the barrel receptacle 40.

A supply magazine 44 is positioned in between the forward surface 34 and the rearward surface 36 of the primary housing 32. The supply magazine 44 is connected to the primary housing 32 by an axle pin 46. The axle pin 46 passes through the geometric center of the supply magazine 44, thereby enabling the supply magazine 44 to rotate freely within the confines of the primary housing 32.

The primary housing 32 does not fully envelop the supply magazine 44. Consequently, a portion of the supply magazine 44 lay exposed, protruding from the primary housing 32.

Loading chambers 48 are periodically formed in the supply magazine 44. Each of the loading chambers 48 is a bore that is formed directly through the structure of the supply magazine 44. The loading chambers 48 are symmetrically disposed around the center of the supply magazine 44 and are positioned to align with both the barrel receptacle 40 and barrel extension 42 at certain rotational positions. It will therefore be understood that as the supply magazine 44 is rotated in the primary housing 32, the various loading chambers 48 will pass in between the barrel receptacle 40 and the barrel extension 42.

Detents 52 are formed on the periphery of the supply magazine 44. A spring pawl 54 is provided within the primary housing 32. As the supply magazine 44 rotates, the spring pawl 54 engages the detents 52 on the supply magazine 44 and holds the supply magazine 44 into a set position. The detents 52 are positioned so that the loading chambers 48 align with both the barrel receptacle 40 and the barrel extension 42 when the spring pawl 54 engages a detent 52. The detents 52 are shallow. Accordingly, although the spring pawl 54 engages a detent 52, the supply magazine 44 can still be readily rotated if manually turned.

Cleaning projectiles 50 are placed into the loading chambers 48. The cleaning projectiles 50 can be round, oblong or cylindrical, having a maximum outside diameter that is larger than the inside diameter of the barrel 20. The cleaning projectiles 50 are placed into the loading chambers 48 by manually rotating the supply magazine 44 and exposing each of the loading chambers 48 in turn.

Figure 3:
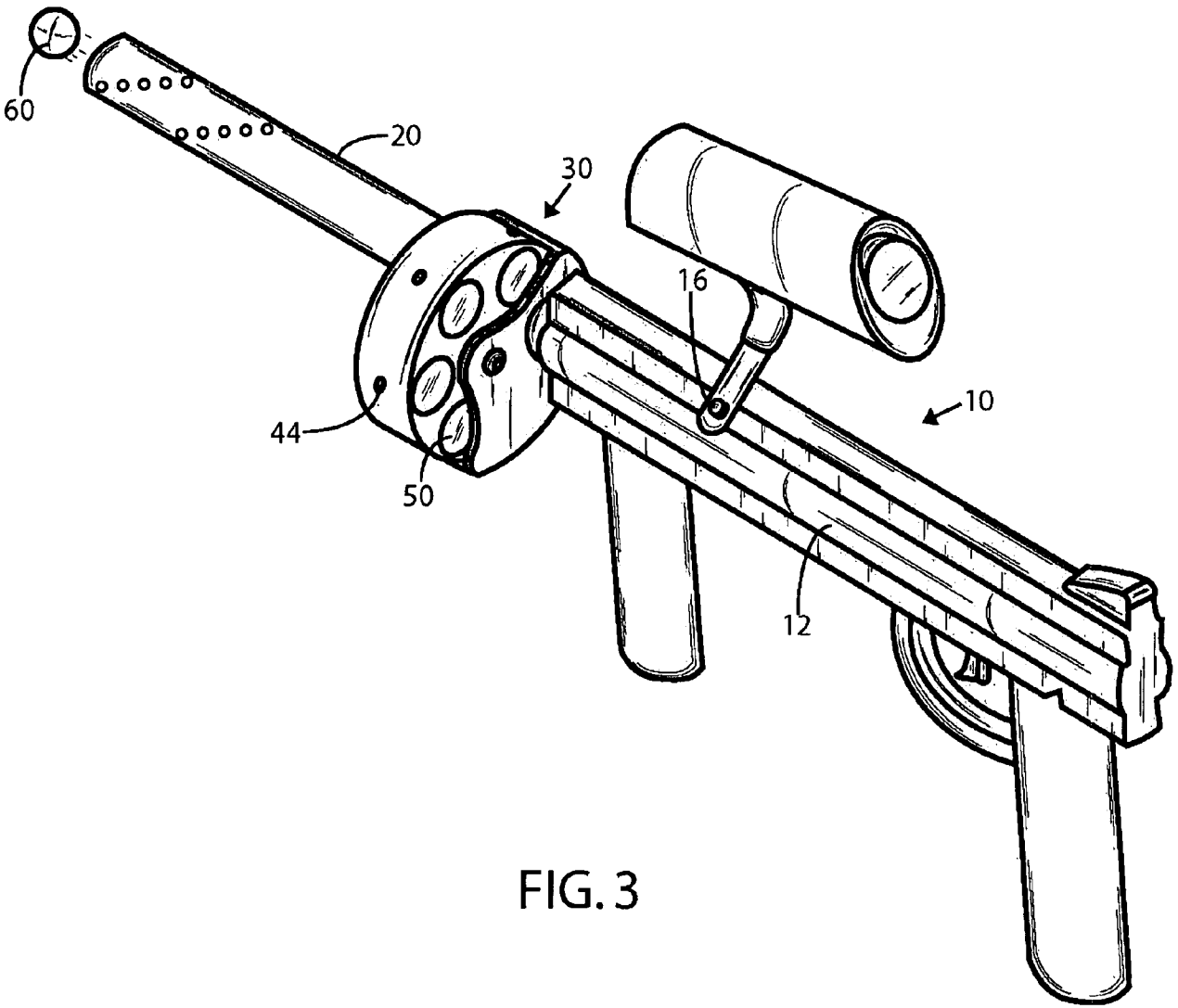
FIG. 3 is a perspective view of the present invention assembly of FIG. 2 attached to the prior art paintball marker of FIG. 1.

Referring to FIG. 3, it can be seen that the assembly 30 is attached to both the gun frame 12 of the paintball marker 10 and the barrel 20 of the paintball marker 10. The assembly 30 is interposed between the barrel 20 and the gun frame 12 so that any paintball 60 fired from the paintball marker 10 must pass through the assembly 30 before reaching the barrel 20. The assembly 30 is positioned completely outside the gun frame 12 of the paintball marker 10. Thus, the assembly 30 has no effect on the ability of the paintball marker 10 to receive a paintball 60 from the hopper 18 and fire that paintball 60.

Many paintball markers have barrels that are vented. That is, holes are drilled in the barrel at points along the length of the barrel. If a lightweight cleaning projectile is fired using only pneumatic pressure, the cleaning projectile may not clear a vented barrel. This is especially true if the barrel is heavily fouled. In prior art systems where a cleaning projectile is placed directly into the breach chamber, this cannot be avoided. The presence of the cleaning projectile prevents a paintball from loading and firing.

In the present invention assembly 30, the cleaning projectile 50 is held outside the breach chamber 16 of the paintball marker 10. A paintball 60 will therefore load into the breach chamber 16 in the normal fashion. Once the paintball 60 is fired out of the breach chamber 16, the paintball 60 intercepts the cleaning projectile 50 in the present invention assembly 30, before the cleaning projectile 50 and the paintball 60 pass into the barrel 20. Since the cleaning projectile 50 is positioned in front of the fired paintball 60, the paintball 60 pushes the cleaning projectile 50 through the barrel 20. Thus, even if the barrel 20 is vented and heavily fouled, the momentum of the paintball 60 will push the cleaning projectile 50 through the barrel 20. The cleaning projectile 50 contacts the interior of the barrel 20 and wipes it clean as it passes. Thus, by firing the cleaning projectile 50 out of the barrel 20, the barrel 20 is cleaned.

Once a cleaning projectile 50 is fired, the pathway between the breach chamber 16 and the barrel 20 is unobstructed. The paintball marker 10 will therefore operate normally. Once a paintball breaks in the barrel 20 and the barrel 20 becomes fouled. The supply magazine 44 is rotated and a new cleaning projectile 50 is positioned between the breach chamber 16 and the barrel 20. The next shot will project the cleaning projectile 50 through the barrel, thereby cleaning the barrel 20.

It will be understood that a person skilled in the art can make many alterations to the shown embodiment of the present invention using functionally equivalent parts and configurations. For instance, the present invention assembly can be permanently manufactured as part of the paintball marker frame. Furthermore, the supply magazine can be encased behind a door to prevent the supply magazine from becoming damaged or dirtied during play. All such variations, modifications and alternate embodiments are intended to be included within the scope of the present invention as defined by the claims.

What is claimed is:

1. A method of cleaning the barrel of a pneumatic gun, comprising the steps of:

providing an assembly that holds at least one cleaning projectile;

attaching said assembly to said pneumatic gun;

attaching said barrel to said assembly; and firing a projectile from said pneumatic gun, wherein said projectile causes a cleaning projectile to be displaced from said assembly and advance through said barrel.

2. The method according to claim 1, wherein said pneumatic gun has a threaded port in line with said barrel and said step of attaching said assembly to said pneumatic gun includes attaching said assembly to said threaded port.

3. The method according to claim 1, wherein said assembly holds a plurality of cleaning projectiles.

4. The method according to claim 2, further including the step of positioning one of said plurality of cleaning projectiles in between said pneumatic gun and said barrel.

5. The method according to claim 3, wherein said assembly includes a magazine having multiple loading ports, wherein each of said loading ports hold one of said plurality of cleaning projectiles, and wherein said step of positioning one of said plurality of projectiles in between said pneumatic gun and said barrel includes manually manipulating orienting one of said loading ports between said pneumatic gun and said barrel.

6. An assembly for supplying at least one cleaning projectile to a paintball marker having a removable barrel, said assembly including:

a housing;

a barrel extension protruding from said housing for joining said housing to said paintball marker;

a barrel receptacle protruding from said housing for joining said housing to said barrel; and a supply magazine for retaining a plurality of cleaning projectiles, wherein said supply magazine is supported by said housing and can be selectively positioned relative said housing in order to individually position said cleaning projectiles between said barrel extension and said barrel receptacle.

7. The assembly according to claim 6, wherein said supply magazine is a wheel structure that is centrally connected to said housing with an axle pin, wherein said wheel structure can be selectively rotated around said axle pin.

8. The assembly according to claim 6, wherein said barrel extension is externally threaded.

9. The assembly according to claim 6, wherein said barrel receptacle is internally threaded.

10. A paintball marker assembly, comprising:

a gun frame;

a breach chamber supported by said gun frame;

a barrel; and a supply magazine interposed between said breach chamber and said barrel, said supply magazine including a wheel structure that is centrally connected to said gun frame with an axle pin, wherein said wheel structure includes a plurality of loading chambers that can be selectively aligned with said breach chamber and said barrel by selectively rotating said wheel structure around said axle pin.

11. The assembly according to claim 10, wherein said supply magazine mechanically interconnects said barrel with said gun frame.

12. The assembly according to claim 11, wherein said gun frame has a threaded barrel port and said supply magazine includes a housing that engages said threaded barrel port.

13. The assembly according to claim 12, wherein said barrel has a threaded end and said housing has a threaded receptacle that receives said threaded end.

14. The assembly according to claim 10, wherein loading ports are symmetrically disposed in said wheel structure around said axle pin.

* * * * *